United States Patent [19]

Oliver

[11] Patent Number: 4,607,380

[45] Date of Patent: Aug. 19, 1986

[54] HIGH INTENSITY MICROFOCUS X-RAY SOURCE FOR INDUSTRIAL COMPUTERIZED TOMOGRAPHY AND DIGITAL FLUOROSCOPY

[75] Inventor: David W. Oliver, Schenectady, N.Y.

[73] Assignee: General Electric Company, Schenectady, N.Y.

[21] Appl. No.: 623,903

[22] Filed: Jun. 25, 1984

[51] Int. Cl.[4] ..... H01J 35/14; H01J 35/26

[52] U.S. Cl. ..... 378/138; 378/58; 378/130

[58] Field of Search ..... 378/58, 138, 119, 121, 378/125, 43, 51, 127, 130

[56] References Cited

U.S. PATENT DOCUMENTS 4,392,238 7/1983 Lersmacher et al. ..... 378/144
4,414,681 11/1983 Seifert ..... 378/144

FOREIGN PATENT DOCUMENTS 2131224 6/1984 United Kingdom ..... 378/138

OTHER PUBLICATIONS

Kagawa et al., "Heavy Duty Rotating Anode X-Ray Tube with Ultra Fine Focus for Enlargement Radiography", Shimadzu Rev. (Japan), 30(2-3), 1973, pp. 155-165.

"A New High Heat Load X-Ray Tube" by Arthur H. Iverson and Stephen Whitaker (presented at the SPIE-Medicine XII, 2/26-29/84.

"Boiling Burnout with Water in Vortex Flow", W. R. Gambill & N. D. Greene, *Chemical Engineering Progress*, 10/58, vol. 54, No. 10, pp. 68-76.

*Primary Examiner*—Carolyn E. Fields
*Attorney, Agent, or Firm*—Paul R. Webb, II; James C. Davis, Jr.

[57] ABSTRACT

A high intensity microfocus x-ray source for the inspection of superalloy objects and the like operates at a voltage of the order of 400-500 kV with an electron beam focal spot size of the order of 2-10 mils and at power levels of tens to hundreds of kilowatts and affords a brightness improvement of at least three thousand over conventional x-ray sources.

15 Claims, 7 Drawing Figures

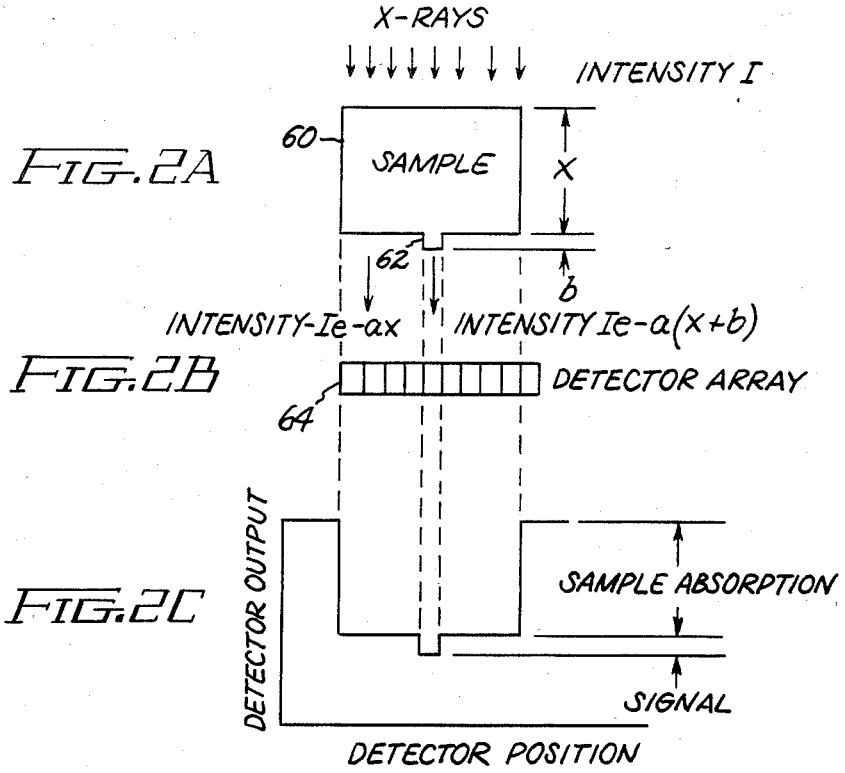
FIG. 3
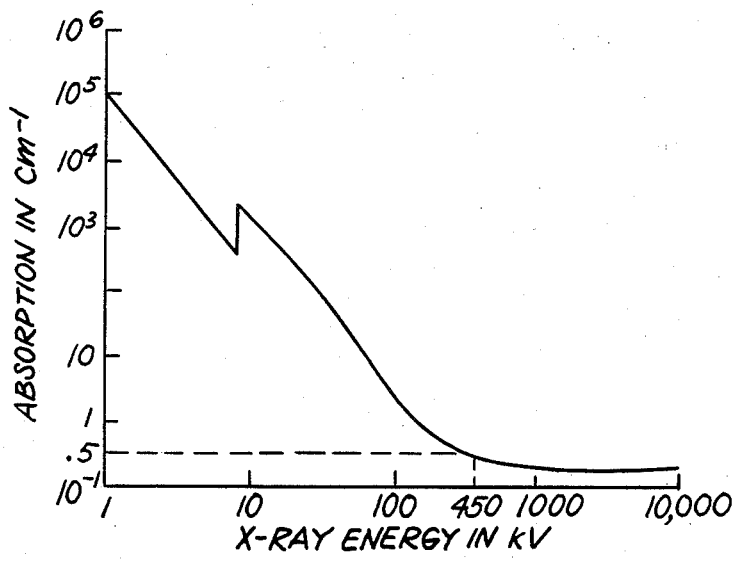

HIGH INTENSITY MICROFOCUS X-RAY SOURCE FOR INDUSTRIAL COMPUTERIZED TOMOGRAPHY AND DIGITAL FLUOROSCOPY

BACKGROUND OF THE INVENTION

This invention relates generally to x-ray methods and sources, and more particularly to x-ray methods and sources for the industrial inspection of objects, such as, thick or superalloy parts and the like.

Although x-ray radiography techniques such as computerized tomography (C.T.) and digital fluoroscopy (D.F.) have found wide applicability and have been shown to have significant advantages in some fields, such as medicine, the industrial application of such techniques in certain areas has been hampered by the lack of suitable x-ray sources. One such area is the x-ray inspection of superalloy turbine blades for high performance aircraft engines. Superalloys include nickel, cobalt and iron based alloys which have high strength at high temperatures. The applicability of x-ray radiography techniques to the inspection of such parts has been limited by the low intensity and poor image quality obtainable with conventional x-ray tubes due to the absorption of photons in the material being inspected, as well as by the rather slow speed and lack of resolution and penetration capability of such sources. One way to improve speed, resolution and penetration capability is to increase the intensity of the source. To inspect high atomic number parts, as of superalloys, this implies the need for a high intensity x-ray source capable of operating at substantially higher voltages than currently available sources, preferably of the order of 400–500 kV, and at high power ratings, preferably in the range of tens to hundreds of kilowatts. Moreover, since it is necessary to resolve very small microflaws having a size of the order of thousandths to tens of thousandths of an inch, it is necessary for the source to have a small focal spot size of the order of 1–10 mils in order to obtain high brightness, i.e., intensity, while minimizing power supply requirements.

There are no x-ray sources currently available which satisfy these requirements. Conventional fixed anode x-ray tubes have limited power dissipation capability. Conventional rotating anode x-ray tubes can dissipate substantial amounts of power, but they operate at about 120 kV which are substantially lower voltages than required, and at full power they typically have an electron beam spot size of the order of 1–1.5 mm. To image a 10 mil flaw using such a tube and a detector aperture of the order of 10 mils, it is necessary to operate with the tube approximately nineteen inches away from the detector in order to resolve the flaw. Employing a smaller spot size would enable the source to be moved closer to the part thereby affording advantages in increased resolution and brightness for the same input power to the tube, or alternatively a reduction in power supply requirements for the same brightness. However, a smaller spot size increases the power density incident upon the anode (assuming the input power to the tube remains the same) since the electron beam is focused onto a smaller area of the anode, and increases the temperature rise of the portion of the anode under the spot, which increases the amount of heat which must be transferred from the anode. The maximum input power to an x-ray tube is limited by melting of the anode, and the power rating of conventional tubes is determined by the anode volume in which heat must be dissipated, which is determined by the area of the spot and the depth of diffusion of the heat. Accordingly, it has not been thought possible to realize a high voltage, high power microfocus x-ray tube having the characteristics required for optimum inspection of superalloy parts.

SUMMARY OF THE INVENTION

The invention provides a new and improved x-ray source having the desired above-noted characteristics necessary for the inspection of superalloy turbine blades, and a method of x-ray inspection of such blades to detect microflaws therein. The invention goes against conventional teaching that an x-ray source capable of operating at voltages of the order of 400–500 kV with a spot size of the order of the size of ten mils or less, for example, and capable of operating at power levels of tens to hundreds of kilowatts, was unobtainable due to melting of the anode. The invention is based upon the discovery that at such voltages a different heat transfer mechanism obtains than that predicted by the prior art due to electron scattering in the anode, and that this heat transfer mechanism enables attainment of a source having the desired characteristics.

Briefly stated, the invention affords a method of x-ray inspecting objects to detect a microflaw therein by using an x-ray tube having an electron beam source, a rotating anode, and means for focusing the electron beam onto the anode to produce x-rays, which comprises operating the electron beam source and the anode at a potential difference of the order of 400–500 kV, focusing the electron beam onto the anode with a spot size of the order of or less than the size of the microflaw so as to emit x-rays, passing the x-rays through the object, and detecting the x-rays passed through the object.

The invention further provides a high intensity microfocus x-ray source for inspecting an object to detect a microflaw that comprises a source for producing an electron beam, a rotating anode, means for focusing the electron beam onto the rotating anode with a spot size of the order of or less than the size of the microflaw, means for operating the anode and the electron beam source at a potential difference of the order of 400–500 kV, and means for applying a coolant to the anode to remove heat therefrom.

BRIEF DESCRIPTION OF THE DRAWINGS

FIGS. 2A–C are diagrammatic views illustrating the x-ray inspection of an object;

FIG. 3 is an x-ray absorption curve for nickel;

DESCRIPTION OF THE PREFERRED EMBODIMENT

As noted earlier, the invention affords an x-ray source and method that are particularly well adapted to the inspection of objects, such as superalloy turbine blades, and will be described in that environment. However, as will be appreciated from the description that follows, this is illustrative of only one utility of the invention.

Figure 1:
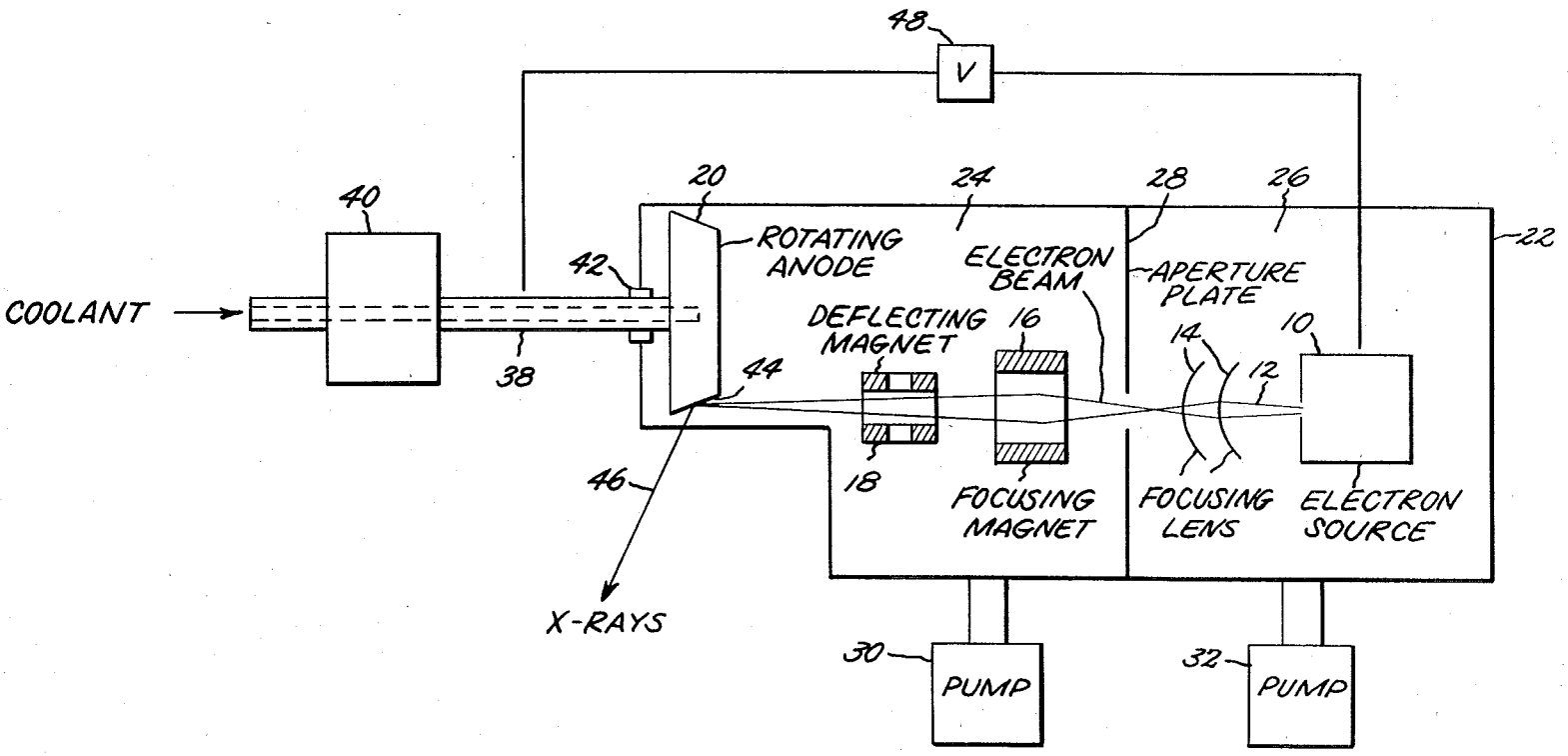
FIG. 1 is a diagrammatic view of a rotating anode microfocus x-ray source in accordance with the invention.

FIG. 1 illustrates diagrammatically a rotating anode microfocus x-ray source (tube) in accordance with the invention. As shown, the tube may comprise an electron source 10 for producing an electron beam 12, focusing lenses 14 and a focusing magnet 16 for focusing the electron beam, a deflection system 18 which may also comprise a magnet, and a rotating anode 20, all disposed within an enclosure 22. The enclosure may be divided into two portions 24 and 26 by an aperture plate 28, and vacuum pumps 30 and 32 may be included for evacuating the two portions of the enclosure. A pumped enclosure as shown is more convenient than a permanently sealed enclosure as is typical of conventional x-ray tubes, since this facilitates maintenance of the anode and the cathode of the electron source. The use of an aperture plate to separate the enclosure into two parts and the use of dual pumps is particularly desirable if a hollow cathode electron source is utilized.

The electron source may be a Pierce-type electron gun, as described hereinafter, and conventional electrostatic and magnetic lenses and deflection systems may be employed for the focusing lens, the focusing magnet and the deflection magnet. Anode 20, which may comprise a material such as tungsten, may be rotated by means of a hollow shaft 38 connected to a drive motor 40. The shaft may enter enclosure 22 through a rotating seal 42, a ferrofluid seal, for example, and a coolant, such as water or a dielectric, e.g., oil, may be pumped through the hollow shaft 38 by means not illustrated to cool the anode by removing the heat generated by the electron beam impinging thereon. A power supply 48 producing a potential V may be connected in a conventional manner between the electron source and the anode to establish the operating voltage V of the tube. The electron beam produced by the electron source is focused onto an inclined surface 44 of the rotating anode so as to have a small spot size. The electron beam impinging upon surface 44 produces x-rays 46 which exit the tube and which may be passed through a turbine blade or other object being inspected. The x-rays passing through the object may be detected by a detector array (not illustrated) to produce an image in a well-known manner.

The effective x-ray distribution in the object being inspected determines the resolution, and the resolution is a function of detector size, source size and position. The detector elements of conventional detector arrays have dimensions of the order of 5–10 mils. In order to resolve and image microflaws of the order of 10 mils in the turbine blade, it is desirable that the electron beam be focused onto the anode so as to have a spot size of 10 mils or less, in the range of 2–10 mils, for example, so as to produce an x-ray beam 46 of comparable size. In addition to affording increased resolution, a small spot size has a number of other significant advantages. It affords a reduction in power supply requirements and/or improved brightness, and, as will be described hereinafter, affords improved heat transfer.

The power supply requirements are proportional to the square of the electron beam focal spot size, for the same brightness. If the spot size is reduced from 1.5 mm, which is typical for a conventional rotating anode tube, to 10 mils (0.25 mm), i.e., by a factor of 6, the power requirements of the tube and, accordingly, of the power supply are reduced by a factor of 36. Alternatively, for the same power input, an increase of 36 times in brightness may be obtained, or the power supply requirements may be reduced by less than a factor of 36 and simultaneously an increase in brightness obtained. There are a number of electron beam devices which are capable of producing extremely fine focal spots, such as electron microscopes, scanning electron microscopes, and microfocus x-ray tubes for precise crystallographic studies or for making electron beam masks. Focusing and deflection systems similar to those employed in such devices may be used for producing the desired focal spot size.

The need for a high voltage tube may be appreciated from an analysis of signal to noise ratio for either a C.T. or a D.F. system and from the x-ray absorption characteristics of superalloys. Referring to FIGS. 2A–C, assume x-rays of intensity I impinge upon an object 60 having a bump 62, and the x-rays passing through the object are detected by a linear detector array 64, as shown in FIG. 2B. The signal is the difference between the detector output under the bump and the output of the detectors that are not under the bump, which corresponds to the noise level. The signal to noise ratio (S/N) is given by $$S/N=\tfrac{1}{2}I^{\frac{1}{2}}e^{-ax/2}(1-e^{-ab}) \quad (1)$$

where a is the x-ray absorption coefficient, x is the thickness of the object, b is the thickness of the bump which is to be detected, and I is the number of incident photons.

The first exponential in Equation (1) accounts for the decrease in the number of photons as the object absorption or thickness increases. The term in parenthesis indicates that the absorption must be large if the change due to the bump is to be large. Inspection of Equation (1) shows that there is a value of absorption coefficient for which the signal to noise ratio is maximized. This occurs because the first term is a rapidly decreasing exponential, and the second term is a slowly rising exponential. The maximum S/N may be found by differentiating Equation (1) with respect to the absorption coefficient, from which the optimum value of absorption may be found to be simply 2/x. Accordingly, in performing C.T. on superalloy turbine blades having a maximum thickness of the order of four inches (10 cm), the optimum absorption coefficient is 0.2 inverse centimeters. Since absorption varies with x-ray energy in kV, this establishes the optimum operating voltage of the x-ray tube.

FIG. 3 illustrates an absorption curve for nickel, which is representative of the superalloys. The primary band of hard radiation from an x-ray tube excited well beyond its absorption edge will be at about one-half of the tube voltage. Thus, a 450 kV tube will excite a band of approximately 225 kV x-rays and, from FIG. 3, the absorption coefficient will be approximately 0.5, which is close to the optimum point. If the superalloy includes five percent or more tungsten for lattice parameter and carbide control, then the absorption coefficient will actually be a factor of two times higher. FIG. 3 clearly illustrates that it is essential that the tube voltage be well beyond the 60 kV rating of conventional rotating anode tubes, because at such voltages the absorption would be approximately 100 $cm^{-1}$, and this voltage would be appropriate for samples having a thickness of only approximately 8 mils. FIG. 3 also shows that beyond approximately 450 kV, only modest improvements in penetration occur with increasing voltage. However, as shown by Equation (1), increases in intensity improve signal to noise by their square root, and to estimate the limits of the intensity improvement available, it is necessary to examine heat transfer from the anode.

The intensity or brightness of an x-ray tube is related to the number of electrons per unit area impinging upon the anode, and may be estimated by determining the temperature rise of the anode under the electron beam spot. The temperature rise must be less than the melting temperature of the anode. As previously noted, the temperature rise depends upon the volume in which the heat produced by the electron beam is dissipated, and in the prior art this volume was determined by the area of the electron beam spot on the surface of the anode and the thermal diffusion distance into the anode per unit time. According to accepted theory, as the electron beam spot size decreases, the time that a particular element of a rotating anode is under the beam decreases so that the heat diffuses in less distance, thereby mandating a lower power density in order to avoid melting of the anode. Thus, to operate a tube at 450 kV, the prior art taught the necessity for a substantially lower current than is desirable to afford good intensity.

It has been discovered, however, that at voltages of 400–500 kV at which it is desired to operate to afford a close to optimum absorption, a phenomenon occurs which was not predicted by the prior art and that a different heat transfer mechanism obtains. Specifically, it has been found that although the thermal distance becomes smaller with reduced spot size, at such higher voltages electron scattering occurs and the depth of penetration of the electrons into the anode is greater than the distance heat diffuses in the time that a point on the anode traverses the beam. Thus, the incident power is initially confined to a volume which is determined by the area of the electron beam spot and a depth equal to the penetration range of the electrons, which penetration depth is of the order of approximately 6 mils at 450 kV for tungsten. Under these conditions, the temperature rise of the anode depends upon how rapidly the electrons lose energy with distance, and the limit on power input is given by $$\frac{P}{A} = \frac{ECTv}{WdE/dx} \tag{2}$$

where P/A is the incident power density, E is the electron beam energy, dE/dx is the loss of electron energy per unit depth at the anode surface, W is the size of the spot, C is the specific heat of the anode, T is the melting point of the anode, and v is the surface velosity of the anode.

Figure 5:
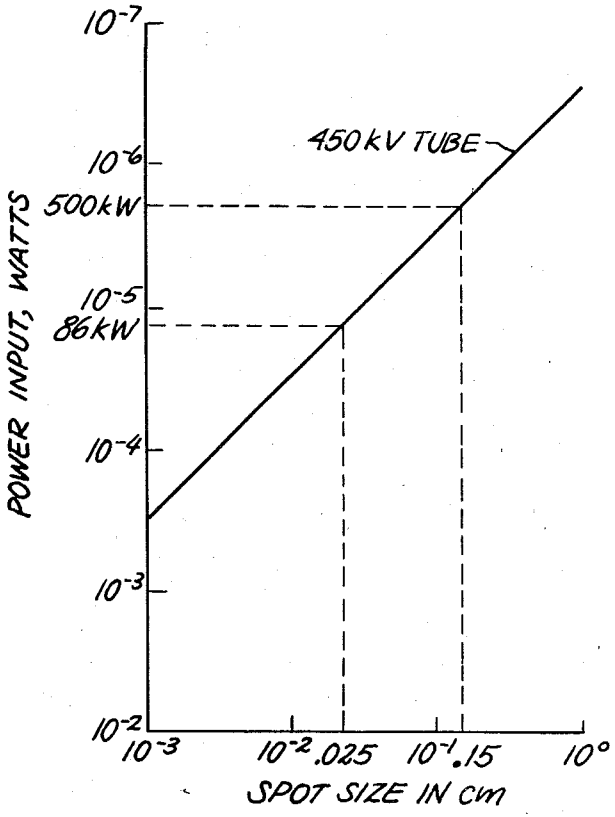
FIG. 5 is a plot of the total input power to a rotating tungsten anode as a function of spot size for a 450 kV tube.
Figure 4:
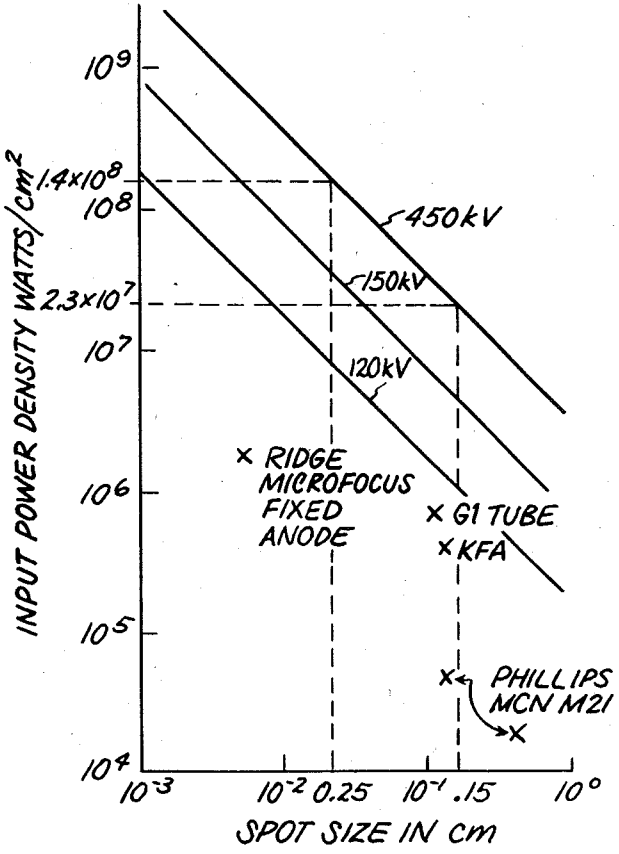
FIG. 4 is a plot of the input power density limit due to melting of a rotating tungsten anode as a function of electron beam spot size for different operating voltages.

FIG. 4 is a log-log plot of the input power density limitation in watts/cm$^2$ versus spot size in cm for a tungsten anode rotating with a surface velocity of 16,000 cm/sec, a speed which has been realized in conventional rotating anode tubes. FIG. 5 is a log-log plot of the total input power to the anode at the melting limit for a 450 kV tube as a function of spot size.

As shown in FIG. 4, for a given spot size, brightness increases with x-ray voltage. This occurs because the energy loss per unit of penetration is less for the higher voltages. In addition, the x-ray yield of a tube operated at 450 kV is twice the yield at 150 kV, which produces a further gain not shown in the figure. FIG. 4 also illustrates that by reducing spot size from 0.15 cm to 0.025 cm, there is a further gain of six times in brightness.

The importance of a small spot size is also shown quantitatively in FIG. 5. As shown, a 0.025 cm (10 mil) spot is driven to maximum brightness with approximately 86 kW of power. In contrast, a 0.15 cm spot requires 500 kW to achieve only 1/6th the same brightness.

For comparison purposes, several points are plotted in FIG. 4 for existing x-ray tubes. The point labeled G1 tube is for a General Electric rotating anode tube which operates at 120 kV. This tube employs a sealed vacuum chamber and radiation cooling of the anode, and can be operated at 56 kW total input power, as plotted, but only for approximately ten second periods due to the inability of removing the average power from the anode by radiation cooling. The point in the Figure labeled KFA is for a water cooled 100 kW tube built by Kernforschungsanlange Julich Gmbh, a German nuclear research center. The power density of this tube is somewhat lower than that of the Maxi Ray because the KFA tube uses a rectangular spot 0.14 cm by 1.4 cm, which has greater thermal spreading resistance than does a square spot. These two data points are in reasonable agreement with the power density estimates provided by Equation (2).

The fixed anode tubes presently employed in industrial C.T. systems have a spot size of the order of 1.4 mm and a power density capability of only about 56 kW/cm$^2$. In contrast, as shown in FIG. 4, the heat transfer limit for a 450 kV rotating anode tube with a 10 mil spot size in accordance with the invention is of the order of 140,000 kW/cm$^2$, or approximately 2500 times greater. This power density gain is only a part of the total improvement afforded by the invention because, in addition, the yield of x-rays goes up from approximately 1% at 60 kV to approximately 4.6% at 450 kV, which affords an overall x-ray brightness improvement of the order of about 10,000 times. However, several additional factors must be considered, such as removal of heat from the rotating anode, cathode brightness, and anode fatigue in order to determine the overall improvement actually attainable.

As shown in FIG. 5, and as noted above, the total average power to be removed from a 450 kV tube with a 10 mil anode spot is of the order of 86 kW. Since power varies inversely with spot size, less power must be removed for finer anode spots. The KFA tube referred to previously has been shown to be capable of providing heat removal as well as of maintainng a vacuum seal at power levels of the order of 100 kW. This tube employs a turbomolecular high speed turbine pump. The rotating anode is mounted on the same shaft as the turbomolecular pump, and the pump throat serves as the vacuum seal. Water cooling is provided through the hollow pump and motor drive shaft. The bearings run in air and can be oil lubricated, and rotation speeds in the range of 10,000 to 50,000 rpm can be achieved. Pumping rates are very high and may be maintained down to 10 torr. This shows that it is feasible to achieve the required power removal from the anode and to maintain a good vacuum, and an arrangement similar to the KFA tube may be employed, if desired, in the rotating anode tube of FIG. 1.

The brightness of the electron beam at the anode, A/cm$^2$, is dependent upon the brightness of the electron source. As noted earlier, for a 10 mil spot size, the incident power is about 86 kW at 450 kV, which requires a current of approximately 200 mA and affords a brightness of about 400 A/cm$^2$. Potential cathode types which may be employed in the tube of FIG. 1 are hollow cathodes, high field cathodes, and thermionic cathodes. Of the three, thermionic cathodes offer the best performance and reliability, and may be employed in an electron gun which focuses or compresses the cathode emission to a point so as to afford a small beam diameter. A compression ratio of the order of 100 may be achieved with a Pierce-type electron gun. With a gun of this type and a compression ratio of 100, a current density at the rotating anode of 400 A/cm$^2$ for a 10 mil spot size implies a cathode emission of 4 A/cm$^2$. At this current density, a tantulum-type cathode has a life of approximately one week, and longer lives may be achieved with zirconium carbide or thoriated tungsten cathodes. Although the total current requirement goes down in proportion to spot size, the electron gun brightness is inversely proportional to spot size and must increase for smaller spot sizes. For a 2 mil spot size, the total current requirement is reduced to 40 mA but the gun brightness increases to 2000 A/cm$^2$ and the cathode emission to 20 A/cm$^2$, which may be achieved with a thoriated tungsten cathode and some loss in reliability. Other types of cathodes which may be employed for various cathode emission ranges are indicated in the following table.

| | Evaporation Life in Days for 1 mil Loss | | | | |
|---|---|---|---|---|---|
| Cathode Emission (A/cm$^2$) | Tungsten | Tantulum | Zirconium Carbide | Barium Aluminate Calcium Oxide | Thoriated Tungsten |
| 0.5 | 245 | 1200 | | | |
| 1 | 74 | 220 | | | |
| 2 | 21 | 49 | | | |
| 5 | 4 | 7 | | | |
| 8 | | | 360 | 900 | 3600 |
| 10 | 1 | 2 | | 700 | 2800 |
| 20 | | | | | 850 |

Electrons at 450 kV penetrate a tungsten anode approximately 3 mils in the process of slowing to an energy of 200 kV, and will have a lateral scatter that begins to become appreciable at spot sizes below 2 mils. The result is that the effective size of the spot emitting x-rays may be larger than the size of the electron beam spot on the anode.

Accordingly, a lower limit of 2 mils on spot size appears to be reasonable because of cathode brightness limitations and lateral scatter of electrons. In addition, in any electron gun, two effects which can limit focusing to a fine spot are thermal broadening and space charge broadening which causes a beam to approach a finite neck and then expands before striking a target. Neither of these effects will limit gun performance for a 450 kV gun because of the low perveance which results from the high voltage. However, for spot sizes from two to ten mils, the foregoing illustrates that it is possible to achieve the heat transfer brightness limits of FIG. 4, and that the invention is capable of providing x-ray tubes having a brightness of the order of 3000 times that of currently available tubes. This enables unique cross-section C.T. images to be produced, which may have been previously unattainable, of objects formed of high atomic number materials, and affords a significant improvement in speed, resolution and penetration capability for the industrial inspection of superalloy parts, such as turbine blades.

While a preferred embodiment of the invention has been shown and described, it will be apparent to those skilled in the art that changes can be made in this embodiment without departing from the principles and spirit of the invention, the scope of which is defined in the appended claims.

What is claimed is:

1. A method of x-ray inspecting an object to detect a microflaw therein by using an x-ray tube having an electron beam source, a rotating anode, and means for focusing the electron beam onto the anode to produce x-rays, the method comprising operating the electron beam source and the anode at a potential difference of the order of 400–500 kV, focusing the electron beam onto the anode with a spot size of the order of or less than the size of the microflaw so as to emit x-rays, passing the x-rays emitted through the object, and detecting the x-rays passed through the object.

2. The method of claim 1, wherein the microflaw is of the order of thousandths to tens of thousandths of an inch and the spot size is of the order of 2–10 mils.

3. The method of claim 2 further comprising applying a coolant to the rotating anode to remove heat therefrom.

4. The method of claim 1, wherein the tube is operated at a power level of the order of tens to hundreds of kilowatts.

5. The method of claim 1, wherein said object is a superalloy part.

6. The method of claim 5, wherein said superalloy part is a turbine blade.

7. A high intensity x-ray source for inspecting an object to detect a microflaw therein comprising a source for producing an electron beam, a rotating anode, means for focusing the electron beam onto the rotating anode with a spot size of the order of or less than the size of the microflaw, means for operating the anode and the electron beam source at potential difference of the order of 400–500 kV, and means for applying a coolant to the anode to remove heat therefrom.

8. The x-ray source of claim 7, wherein the electron beam source, the anode, and the focusing means are disposed within an enclosure which is adapted to be pumped to provide a vacuum therein and which is constructed to afford access to the electron beam source and the anode.

9. The x-ray source of claim 7, wherein said spot size is of the order of 2–10 mils.

10. The x-ray source of claim 7, wherein said coolant comprises a dielectric liquid.

11. The x-ray source of claim 7, wherein said anode is of tungsten and is rotated at a rate of the order of 16,000 cm/sec.

12. The x-ray source of claim 7, wherein the electron beam source produces a beam current such that the power incident on the anode is in the range of tens to hundreds of kilowatts.

13. The x-ray source of claim 7, wherein the beam current is such as to maximize the intensity of the x-ray source.

14. The x-ray source of claim 7, wherein the electron beam source comprises a Pierce-type electron gun having a beam compression ratio of the order of 100.

15. The x-ray source of claim 14, wherein the electron beam source has a thermionic cathode of a material selected from the group consisting of oxides, carbides and metals.

* * * * *